US007926854B2

(12) United States Patent
Sharma

(10) Patent No.: US 7,926,854 B2
(45) Date of Patent: Apr. 19, 2011

(54) PIPE JOINT BLOCK FOR FLUID TRANSFER

(75) Inventor: Rajeev Sharma, Troy, MI (US)

(73) Assignee: DENSO International America, Inc., Southfield, MI (US)

( * ) Notice: Subject to any disclaimer, the term of this patent is extended or adjusted under 35 U.S.C. 154(b) by 251 days.

(21) Appl. No.: 12/249,373

(22) Filed: Oct. 10, 2008

(65) Prior Publication Data

US 2010/0089561 A1 Apr. 15, 2010

(51) Int. Cl.
*F16L 41/00* (2006.01)

(52) U.S. Cl. ..... 285/208; 285/124.3; 165/176; 165/178

(58) Field of Classification Search ..... 285/124.5, 285/124.3, 124.4, 124.2, 206, 207, 208, 209; 165/178, 153, 176
See application file for complete search history.

(56) References Cited

U.S. PATENT DOCUMENTS

| | | | | | |
|---|---|---|---|---|---|
| 3,908,629 | A * | 9/1975 | Wiese | 165/178 |
| 4,641,863 | A * | 2/1987 | Shemtov | 285/209 |
| 5,348,082 | A * | 9/1994 | Velluet et al. | 165/178 |
| 5,477,919 | A * | 12/1995 | Karube | 165/176 |
| 5,575,330 | A | 11/1996 | Hoeffken | |
| 5,630,326 | A * | 5/1997 | Nishishita et al. | 165/176 |
| 5,785,119 | A | 7/1998 | Watanabe et al. | |
| 6,035,931 | A | 3/2000 | Kado et al. | |
| 6,070,659 | A | 6/2000 | Hosoya | |
| 6,196,306 | B1 | 3/2001 | Aikawa et al. | |
| 6,324,962 | B1 * | 12/2001 | Majkrzak | 285/124.5 |
| 6,443,502 | B1 * | 9/2002 | Iida et al. | 285/124.1 |
| 6,543,530 | B2 | 4/2003 | Watanabe | |
| 6,776,225 | B2 | 8/2004 | Leitch et al. | |
| 6,776,421 | B2 * | 8/2004 | Florence et al. | 285/124.3 |
| 7,174,953 | B2 | 2/2007 | Chiba | |
| 7,219,717 | B2 | 5/2007 | Hanafusa | |
| 7,237,807 | B2 * | 7/2007 | Hiyama et al. | 285/208 |
| 7,311,138 | B2 | 12/2007 | Kazari et al. | |
| 7,604,258 | B2 * | 10/2009 | Getto et al. | 285/124.2 |

* cited by examiner

*Primary Examiner* — David E Bochna
(74) *Attorney, Agent, or Firm* — Harness, Dickey & Pierce, PLC

(57) ABSTRACT

A connection block employs a support block with two parallel through holes that pass through parallel first and second flat block surfaces. First and second insert pipes have elongate portions and flanges. The elongate portions press-fit into the connection block and the flanges, not at pipe ends, abut against the first flat surface of the connection block when the pipes are installed. Upon installation, the ends the elongate portions of the pipes are formed into a flange by flattening the end against the second connection block surface. The junctures of the elongate portions and the first flanges form a flange radius that contacts a radius of the support block when the pipes are installed into the block. The elongate portions residing within the first and second through holes make a full contact fit against the inside diameters of the through holes. The flanges are perpendicular to the elongate portions.

6 Claims, 3 Drawing Sheets

PIPE JOINT BLOCK FOR FLUID TRANSFER

FIELD

The present disclosure relates to a pipe joint block for fluid transfer. More specifically, the disclosure relates to a pipe joint block for connection to another structure, such as a heat exchanger.

BACKGROUND

This section provides background information related to the present disclosure which is not necessarily prior art. Heat exchangers, such as an evaporator for a vehicle air conditioner, typically have a block that serves as the inlet and outlet point for fluid to flow into and from the heat exchanger. As depicted in FIG. 1, the block 2 is typically a one-piece part that is machined from one solid piece of material, such as aluminum. While such one piece blocks have generally been satisfactory for their given purpose, they are not without their share of limitations. One limitation of current blocks is the cost of the single, solid piece of aluminum that is of a special machining grade. Another limitation of current blocks is the amount of time necessary to machine the block and the cost of machining the block. Because the inlet 4 and outlet 6 of the block extend from the support 8 of the block 2, and the entire block is one piece, machining the inlet 4 and outlet 6 involves intricate time consuming steps and consumes expensive machine cutter tooling.

What is needed then is a device that does not suffer from the above disadvantages. This will provide a non-one piece device whose support is manufactured from a smaller overall piece of material and does not require extensive, intricate machining steps.

SUMMARY

This section provides a general summary of the disclosure and is not a comprehensive disclosure of its full scope or all of its features. A connection block may employ a support block defining a first through hole and a second through hole, each hole passing through a first flat surface and a second flat surface of the support block. A support block radius is resident in the support block in the first flat surface around an end of each of the first and second through holes. A first pipe and a second pipe are permanently installed in the support block and each have an elongate portion, and a flange that abuts against the first flat surface of the support block when the pipes are installed. The flanges are perpendicular to the elongate portions and reside at non-end locations of the pipes. The elongate portions reside tightly within the through holes with a press or contact fit against an inside diameter of the through holes.

The pipes each have another flange that is resident at an end location of the pipes and may be formed by hammering or flattening the end of the elongate portion against the second flat surface of the support block after the pipes are installed into the support block. The elongate portions of the pipes and the support block reside between the flanges of each of the pipes. A first passage of the first pipe and a second passage of the second pipe may align with separate fluid passages in a heat exchanger, such as an air conditioning evaporator. A first threaded mounting hole and a second threaded mounting hole may be resident in the support block, between the pipes, for mounting the support block, and press fit and flanged pipes, to the heat exchanger.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure. Corresponding reference numerals may indicate corresponding parts throughout the several views of the drawings.

Figure 5A:
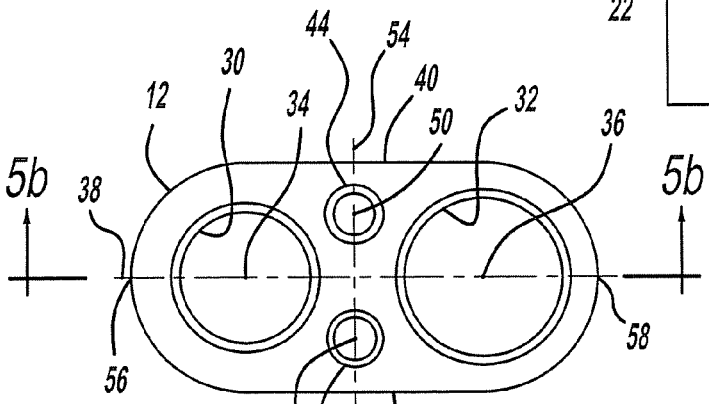
Figure 5B:
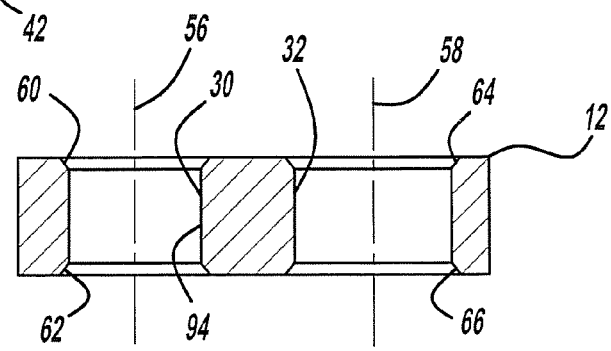
Figure 6:
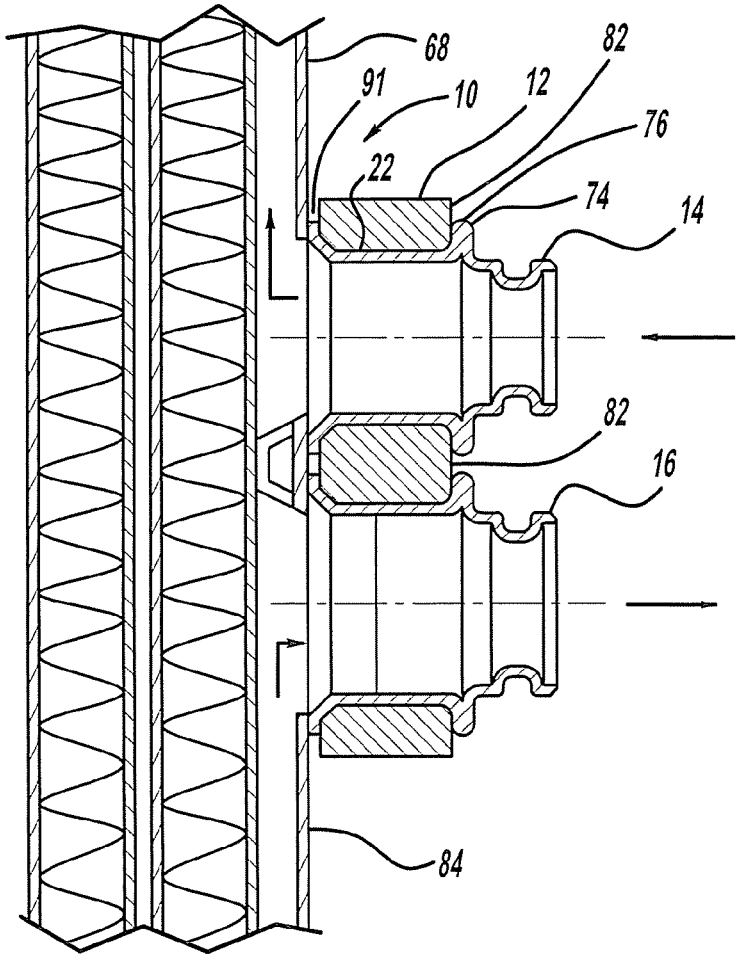
Figure 7:
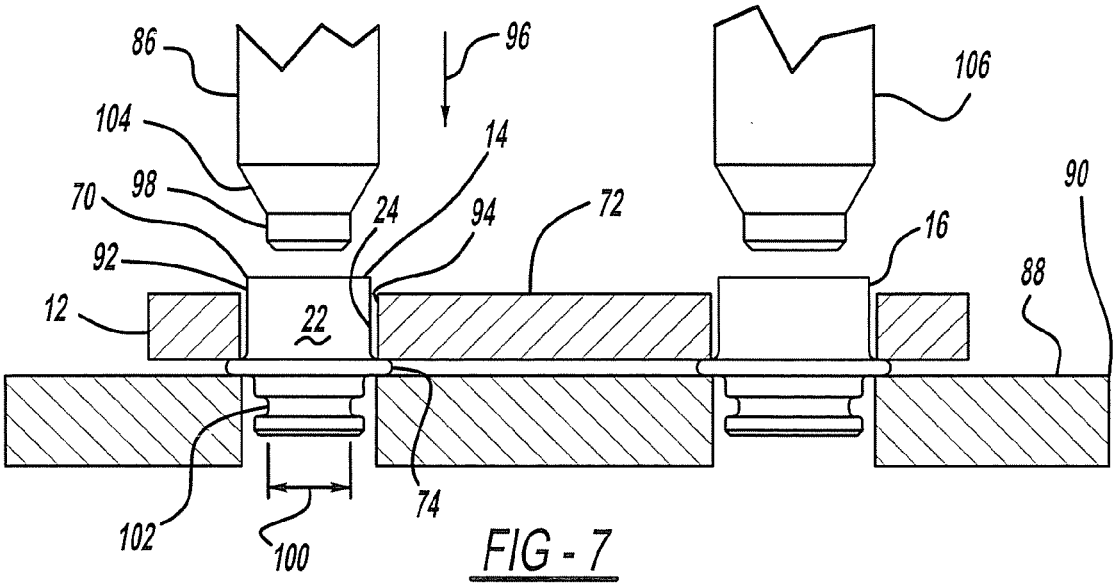

FIG. 5*a* is a top view of a block in accordance with the present teachings;

FIG. 5*b* is a cross-sectional view of the block of FIG. 5*a* in accordance with the present teachings;

FIG. 6 is a cross-sectional view of an assembled male block that is attached to a heat exchanger; and FIG. 7 is a side view of a block and pipes just prior to the assembly of the pipes into the block.

DETAILED DESCRIPTION

Figure 1:
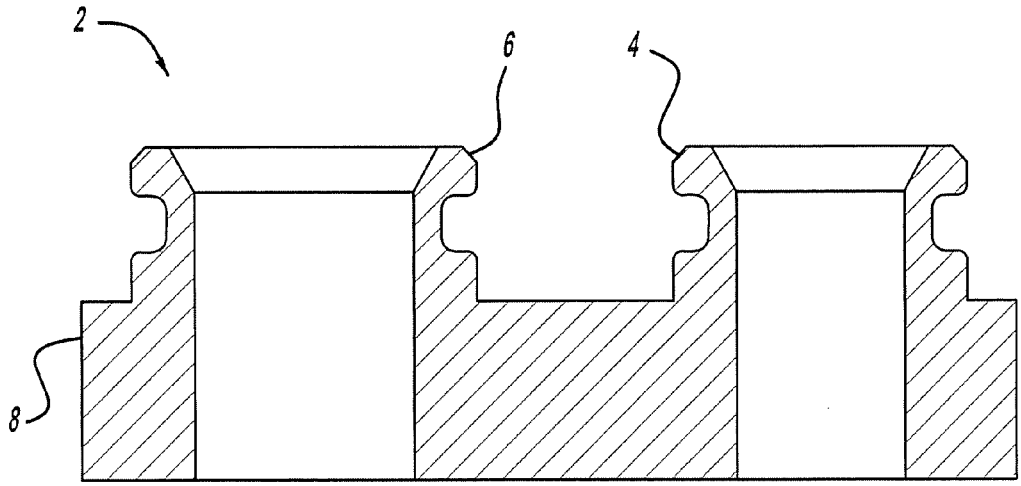
FIG - 1 Prior Art
FIG. 1 is a cross-sectional view of a one-piece male block for an inlet and outlet of a heat exchanger according to the prior art.
Figure 2:
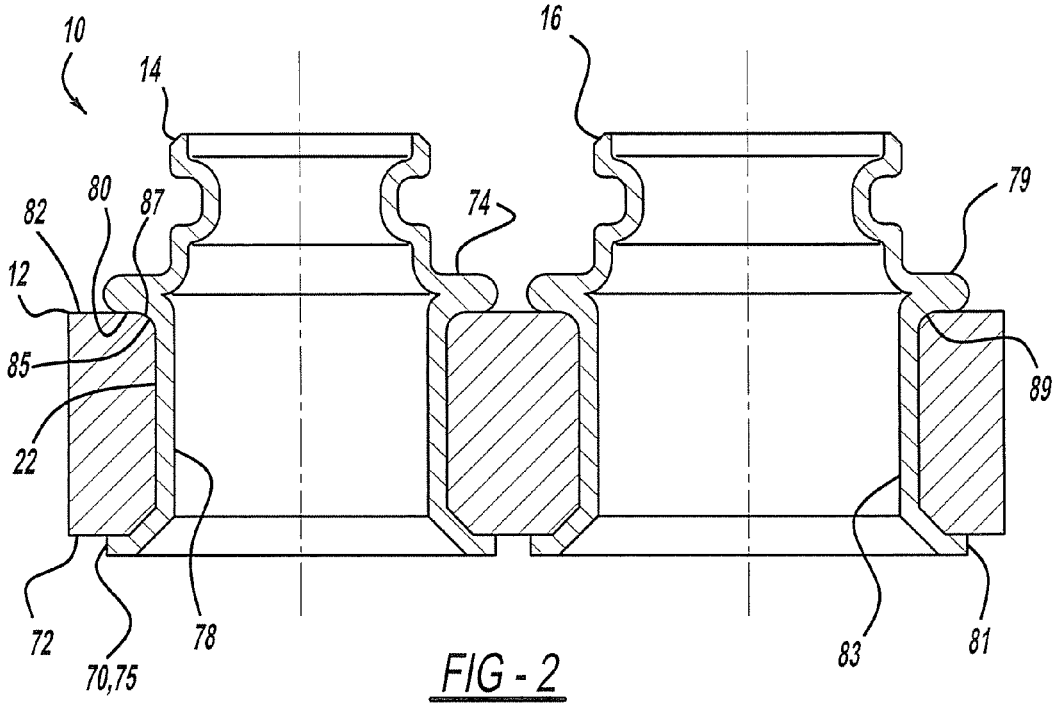
FIG. 2 is a cross-sectional view of a female block for an inlet and outlet of a heat exchanger according to the present disclosure.
Figure 3:
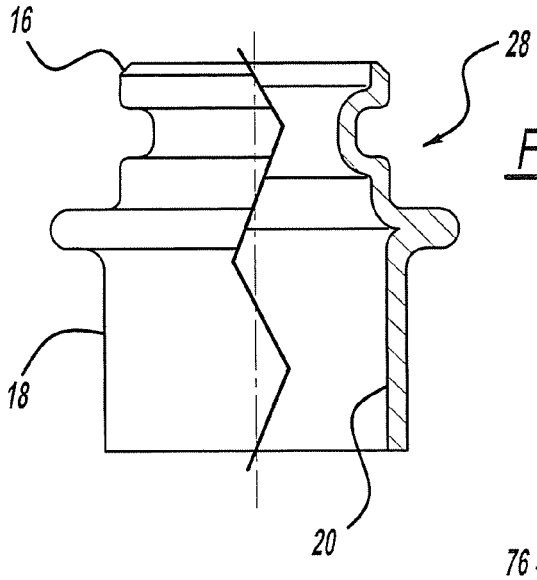
FIG. 3 is a combination side view and a cross-sectional view of a male endform or pipe in accordance with the present teachings.
Figure 4:
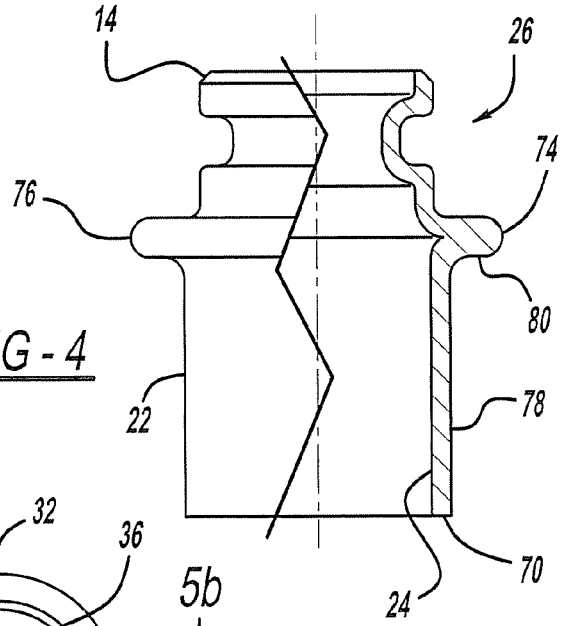
FIG. 4 is a combination side view and a cross-sectional view of a male endform or pipe in accordance with the present teachings.

Example embodiments will now be described more fully with reference to accompanying FIGS. 2-7. FIG. 2 depicts a fully assembled male connection block 10, which is an assembly of a support block 12, a first pipe 14 and a second pipe 16. With additional reference to FIGS. 3-5*b*, aspects of the disclosure will be explained in greater detail. The second pipe 16 is depicted in FIG. 3 while the first pipe 14 is depicted in FIG. 4. The pipes 14, 16, which may be made of a metal such as aluminum, may be manufactured from a variety of manufacturing processes before their installation, either separately or together at the same time, into the block 12. As examples, the pipes 14, 16 may be manufactured by a die cast process with an additional machining step to polish or grind the outside diameter 18 and/or the inside diameter 20 of the second pipe 16 and the outside diameter 22 and/or the inside diameter 24 of the first pipe 14. The machining, or rather the light grinding or polishing of the first pipe 14 and the second pipe 16 may be performed for at least one of two reasons. For instance, machining of the inside diameters 20, 24 may be performed to ensure the desired flow characteristics of a liquid or gas passing through the pipes 14, 16. Performing such steps on the prior art block 2 of FIG. 1 may be intricate, difficult, and expensive given the added size and one-piece shape of the block 2. Additionally, because the shape of the block 2 is may not lend itself to being held while being machined or polished, special jigs or holders may have to be fabricated. With die casting, the desired surface finish of the inside diameters 20, 24 may even be achieved without further machining, which is not possible with the solid block of the prior art block 2.

Continuing, a variety of other manufacturing processes are possible to manufacture the pipes 14, 16. The pipes 14, 16 may be produced in an extrusion process to produce the desired shape and cross-sectional profile and then cut to the desired length in accordance with the thickness or depth of the connection block 10. Alternatively, the pipes 14, 16 may be stamped from Aluminum sheet and then rolled to create the desired profiles 26, 28 at the end of each pipe 14, 16, or the pipes may be manufactured from sheet metal in a deep drawing process.

Turning now to FIGS. 5*a* and 5*b*, the support block 12 will be described. The support block 12 may be a solid piece of aluminum with a first hole 30 and a second hole 32. The holes 30, 32 may be drilled into and completely through the block 12 such that the center 34 of the first hole 30 and the center 36 of the second hole 32 lie on the same longitudinal centerline 38 of the block 12, as depicted. The longitudinal centerline 38 may be equidistant from the parallel sides 40, 42 of the block 12.

Continuing with FIGS. 5*a* and 5*b*, another set of through holes are present in the support block 12. More specifically, a first threaded hole 44 and a second threaded hole 46 may exist in the support block 12 such that their respective centers 50, 52 lie on a transverse centerline 54 that is perpendicular to the longitudinal centerline 38 and that lies equidistant from the ends 56, 58 of the support block 12. Turning to FIG. 5*b*, the support block 12 is depicted in cross-section such that the first hole 30 and second hole 32 have respective centerlines 56, 58 that are parallel to each other. Additionally, the first hole 30, which may be smaller in diameter than the second hole 32, and the second hole 32 are equipped with chamfers around their diameters where each hole 30, 32 meets a flat surface or side of the support block 12. More specifically, and with continued reference to FIG. 5*b*, the hole 30 has a chamfer 60 and a chamfer 62, while the hole 32 has a chamfer 64 and a chamfer 66.

Now including FIG. 6 and with continuing reference to FIG. 2, a male connection block 10 in its assembled condition and connected to a heat exchanger 68, such as an evaporator, is depicted. The male connection block 10 has a first pipe 14, with an end portion 70 that passes entirely through the hole 30 and forms against and contacts a flat surface or side 72 of the support block 12. Similarly, a flange 74 of the first pipe 14 has an outside diameter 76 that is larger than an outside diameter 22 of the elongated portion 78 of the first pipe 14. The flange 74 also has a flat surface 80 that contacts the opposing flat surface 82 of the support block 12. Because the flat surface 80 of the flange 74 is securely held against the flat surface 82 of the support block 12, and the end portion 70 of the first pipe 14 is securely held against the flat surface 72 of the support block 12, the first pipe 14 is securely held in place against an inside diameter of the first hole 30 and within the first hole 30. Additionally, because the outside diameter 22 of the elongated portion 78 of the first pipe 14 is a press fit or interference fit against the inside diameter of the hole 30, the first pipe 14 is securely held in place. Furthermore, the flange 74 against the surface 82 and the end 70 against the surface 72, prevents the first pipe from moving longitudinally, such as when a hose connection or similar connection is made to the first pipe 14. The same securing method is applicable to the second pipe 16, as depicted in FIGS. 2 and 7, and therefore, a detailed explanation will not be repeated.

Continuing with FIG. 6, to further secure the first pipe 14 to the support block 12, and at the same time, to secure the support block 12 to a device with which it is transferring fluids, such as a heat exchanger 68, the male connection block 10 may be welded, brazed, soldered or bolted to the heat exchanger 68. As an example, the flat surface 72 of the support block 12 may be brazed to the surface 84 of the heat exchanger 68. More specifically, and as an added advantage of the present disclosure, the end portion 70 of the elongated portion 78 of the first pipe 14 is also physically brazed to the surface 84 of the heat exchanger 68. In such a manner, not only is the flat surface 72 of the support block 12 brazed to the heat exchanger 68, but the first pipe 14 also is brazed to the heat exchanger 68. Thus, both pieces 12, 14 may be individually connected (brazed, etc.) to the heat exchanger 68. The gap 91 is indicative of where brazing material may be located to contact to the block 12 and the surface 84 of the heat exchanger 68, and the end portion 70 and the surface 84 of the heat exchanger 68. Furthermore, with such a connection method, the first pipe 14 is held into the support block 12 with the end portion 70 formed or bent a total of ninety degrees, from the longitudinal length of the first pipe 14, to secure it in a locked or secured position. More specifically, the end portion 70 is bent or formed from being parallel with the longitudinal length of an inside diameter of the hole 30 to being bent or formed against the flat surface 72 of the support block 12. Again, a brazing or weld material may then fill the gap 91 defined by the surface of the heat exchanger 68 and the support block 12.

As depicted in FIG. 6, the first pipe 14 may serve as an inlet of liquid refrigerant, such as R134A, or another refrigerant, and the second pipe 16 may serve as an outlet of the refrigerant, which may then be in a gaseous form, for example, after expansion within the heat exchanger, such as an air-conditioning evaporator.

Turning now to FIG. 7, an example of how the first tube 14 and second tube 16 may be formed, will be presented. The description to follow focuses on the forming of a first pipe 14; however, the same procedure may be applied to additional pipes, such as second pipe 16. Accordingly, a repeat explanation of the procedure in conjunction with second pipe 16 will not follow. Continuing, FIG. 7 depicts a punch 86 above the first pipe 14, whose flange 74 is resting upon a top surface 88 of a jig 90. The support block 12, into which and through which the first pipe 14 is installed, may be placed over the end portion 70 of the first pipe 14. While FIG. 7 depicts the outside diameter 22 of the first pipe 14 and the support block 12 as defining a gap 92 therebetween, such gap 92 may be proportionally smaller than what is depicted, and in actuality, the outside diameter 22 of the first pipe 14 may actually contact the inside diameter 94 of the first hole 30 in a contact fit or interference fit.

After the first pipe 14 is inserted into the first hole 30 as depicted in FIG. 7, the punch 86 may be moved toward the first pipe 14 in accordance with the direction of arrow 96, the downward direction. The punch moves downwardly until the sizing area 98 of the punch 86 contacts the inside diameter 100 of the neck region 102. The sizing area 98 of the punch ensures that the punch 86 is centered within the first pipe 14. During the insertion of the punch 86 into the first pipe 14, the forming area 104 of the punch 86 will contact the inside diameter 24 of the first pipe 14 at the end portion 70 and will cause the end portion 70 to begin to deform in accordance with the profile of the forming area. The deformation will continue until the punch 86 ceases to move downwardly. Upon reaching its maximum travel, the punch 86 is withdrawn and the outside diameter 22 of the pipe 14 may then be firmly against the inside diameter 94 of the support block 12. The final forming of the end portion 70 flat against the flat surface 72 of the support block 12 may be completed with a flatting operation, such as by hammering or pressing, if necessary. The end result is the male connection block 10 depicted in FIG. 2. A second punch 106 may be used to perform the same punching and forming procedure on the second pipe 16 at the same time as the forming of the first pipe 14. Before the procedure involving the punch 86, described above, the semi-finished first pipe 14, as depicted in FIG. 7, may be manufactured in accordance with any of the manufacturing procedures described above.

Although described above, what is included in the disclosure is a connection block employing a support block 12 defining a first through hole 30, and a first pipe 14. The first pipe 14 may be a separate piece that is non-integral with the support block 12 and that resides within the first through hole 30 using a contact fit. Separate pieces provide the advantage of using the same support block but different pipes that may have different types of connectors on them for various types of tubes or hoses to be connected to the pipes 14, 16. The first pipe 14 may further employ a first flange 74, the first flange 74 residing in contact against a first flat side 82 of the support block 12. The first flange 74 of the first pipe 14 is located at a non-end or central portion of the first pipe 14.

The first pipe 14 may further employ a second flange 75, the second flange 75 formed at an end 70 of the first pipe 14. An elongated portion 78 of the first pipe 14 may reside between the first flange 74 and the second flange 75, and the support block 12 may also reside between the first flange 74 and the second flange 75. The first pipe 14 may protrude completely through the first through hole 30 and the second flange 75 may reside in contact against a second flat side 72 of the support block 12. The first flat side 82 of the support block may be parallel with the second flat side 72. A heat exchanger 68 may define a first heat exchanger fluid hole that aligns with the first pipe 14 to permit passage of fluid. The second flange 75 of the first pipe 14 may contact the heat exchanger 68 when the connection block 10 is connected to the heat exchanger 68.

The support block 12 may further define a first threaded through hole 44 and a second threaded through hole 46 in the support block 12 to secure the support block 12 to the heat exchanger 68. A second pipe 16, as a separate piece from the support block 12, may reside within a second through hole 32 using a contact fit. The second pipe 16 may further employ a third flange 79 residing in contact against the first flat side 82 of the support block 12. The third flange 79 of the second pipe 16 may be located at a non-end portion of the second pipe 16, such as at a central location of the pipe 16. A fourth flange 81 may form an end of the second pipe 16, while an elongated portion 83 of the second pipe 16 resides between the third flange 79 and the fourth flange 81. The support block 12 may also reside between the third flange 79 and the fourth flange 81.

In another example, a connection block 10 may employ a support block 12 defining a first through hole 30 through a first flat surface 82 and a second flat surface 72, a support block radius 85 around a first end of the first through hole 30, and a first pipe 14 having an elongate portion 78 and a first flange 74. A juncture of the elongate portion 78 and the first flange 74 may form a flange radius 87 that contacts all of the support block radius 85. The same is possible regarding the elongate portion 83 and the flange 79. Continuing, the elongate portion 78 may reside within the first through hole 30 with a contact fit against an inside diameter of the first through hole 30. The first flange 74 may be perpendicular to the elongate portion 78 and reside in contact against a first flat side 82 of the support block 12. The first flange 74 of the first pipe 14 may be located at a non-end or central portion of the first pipe 14. The first pipe 14 may further employ a second flange 75 formed at an end of the first pipe 14 such that the elongate portion 78 of the first pipe 14 resides between the first flange 74 and the second flange 75. The support block 12 may also reside between the first flange 74 and the second flange 75. The first pipe 14 may protrude completely through the first through hole 30 while the second flange 75 may reside in contact against a second flat side 72 of the support block 12. The first flat side 82 may be parallel with the second flat side 72.

A heat exchanger 68 may define a first heat exchanger hole such that the first heat exchanger hole may align with a passage of the first pipe 14 to permit fluid flow. The second flange 75 of the first pipe 14 may contact the heat exchanger 68 when the connection block 10 is connected to the heat exchanger 68.

In still yet another example of the disclosure, a connection block 10 may employ a support block 12 that defines a first through hole 30 and a second through hole 32 through parallel surfaces such as a first flat surface 82 and a second flat surface 72 of the support block 12. A first support block radius 85 around a first end of the first through hole 30 and a second support block radius 89 around a first end of the second through hole 32 may facilitate and allow a contact fit for a first pipe 14 and a second pipe 16, respectively.

The first pipe 14 may have a first elongate portion 78, a first flange 74, and a second flange 75. The second pipe 16 may have a second elongate portion 83, a third flange 79, and a fourth flange 81. The first elongate portion 78 may reside within the first through hole 30 with a contact fit against an inside diameter of the first through hole 30, and the second elongate portion 83 may reside within the second through hole 32 with a contact fit against an inside diameter of the second through hole 32. The first flange 74 may be perpendicular to the first elongate portion 78 and reside in contact against a first flat side 82 of the support block 12. The third flange 79 may be perpendicular to the second elongate portion 83 and reside in contact against the first flat side 82 of the support block 12. The second flange 75 may be formed at an end of the first pipe 14 while the fourth flange 81 may be formed at an end of the second pipe 16. The elongate portion 78 of the first pipe 14 and the support block 12 may reside between the first flange 74 and the second flange 75, while the elongate portion 83 of the second pipe 16 and the support block 12 may reside between the third flange 79 and the fourth flange 81. Because the flanges 74, 75, 79, 81 reside around or over the support block 12, the pipes 14, 16 are securely held in place be the geometry of the structure. A first passage of the first pipe 14 and a second passage of the second pipe 16 each align with a fluid passage of a heat exchanger 68.

The connection block of claim 18 may further define a first mounting hole 44 and a second mounting hole 46 for mounting the entire connection block 10 to the heat exchanger 68, such as with threaded bolts or screws. When the support block 12 is mounted to a heat exchanger, as depicted in FIG. 6, the second flange 75 and the fourth flange 81 may contact a surface of the heat exchanger 68. As an alternative to, or in addition to, the threaded bolts mentioned above, the connection block 10 may be brazed to the heat exchanger.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A connection block, comprising:

a support block defining a first through hole;

a first pipe, as a separate piece from the support block, that resides within the first through hole using a contact fit;

a first flange, the first flange residing in contact against a first flat side of the support block, wherein the first flange of the first pipe is located at a non-end portion of the first pipe;

a second flange, the second flange formed at an end of the first pipe, wherein an elongated portion of the first pipe resides between the first flange and the second flange, and the support block also resides between the first flange and the second flange, wherein the first pipe protrudes completely through the first through hole and the second flange resides in contact against a second flat side of the support block, and the first flat side is parallel with the second flat side; and a heat exchanger defining a first heat exchanger hole that aligns with the first pipe to permit passage of fluid, wherein the second flange of the first pipe contacts the heat exchanger when the support block is connected to the heat exchanger.

2. The connection block of claim 1, wherein the support block further defines a first threaded through hole and a second threaded through hole in the support block to secure the support block to the heat exchanger.

3. The connection block of claim 1, further comprising:

a second pipe, as a separate piece from the support block, that resides within a second through hole using a contact fit;

the second pipe further comprising:

a third flange residing in contact against the first flat side of the support block, wherein the third flange of the second pipe is located at a non-end portion of the second pipe; and a fourth flange forming an end of the second pipe, wherein an elongated portion of the second pipe resides between the third flange and the fourth flange, and the support block also resides between the third flange and the fourth flange.

4. A connection block, comprising:

a support block defining a first through hole through a first flat surface and a second flat surface;

a support block radius around a first end of the first through hole;

a first pipe having an elongate portion and a first flange, a juncture of the elongate portion and the first flange forming a flange radius that contacts all of the support block radius, the elongate portion residing within the first through hole with a contact fit against an inside diameter of the first through hole, wherein the first flange is located at a non-end portion of the first pipe, and is perpendicular to the elongate portion and resides in contact against a first flat side of the support block;

a second flange, the second flange formed at an end of the first pipe, wherein the elongate portion of the first pipe resides between the first flange and the second flange, and the support block also resides between the first flange and the second flange, wherein the first pipe protrudes completely through the first through hole, and the second flange resides in contact against a second flat side of the support block, the first flat side parallel with the second flat side; and a heat exchanger defining a first heat exchanger hole, wherein the first heat exchanger hole aligns with a passage of the first pipe to permit fluid flow, wherein the second flange of the first pipe contacts the heat exchanger when the support block is connected to the heat exchanger.

5. A connection block, comprising:

a support block defining a first through hole and a second through hole through a first flat surface and a second flat surface of the support block;

a first support block radius around a first end of the first through hole and a second support block radius around a first end of the second through hole;

a first pipe and a second pipe, the first pipe having a first elongate portion and a first flange and a second flange, the second pipe having a second elongate portion and a third flange and a fourth flange, the first elongate portion residing within the first through hole with a contact fit against an inside diameter of the first through hole, and the second elongate portion residing within the second through hole with a contact fit against an inside diameter of the second through hole, wherein the first flange is perpendicular to the first elongate portion and resides in contact against a first flat side of the support block and the third flange is perpendicular to the second elongate portion and resides in contact against the first flat side of the support block; and the second flange is formed at an end of the first pipe, and the fourth flange is formed at an end of the second pipe, the elongate portion of the first pipe and the support block reside between the first flange and the second flange, and the elongate portion of the second pipe and the support block reside between the third flange and the fourth flange, wherein a first passage of the first pipe and a second passage of the second pipe each align with a fluid passage of a heat exchanger, and the second flange of the first pipe contacts the heat exchanger when the support block is connected to the heat exchanger.

6. The connection block of claim 5, further defining a first mounting hole and a second mounting hole for mounting the connection block to the heat exchanger, wherein the second flange and the fourth flange contact a surface of the heat exchanger when mounted to the heat exchanger.

* * * * *